United States Patent [19]

Sippola

[11] 4,361,448

[45] Nov. 30, 1982

[54] METHOD FOR PRODUCING DUAL-PHASE AND ZINC-ALUMINUM COATED STEELS FROM PLAIN LOW CARBON STEELS

[75] Inventor: Pertti J. Sippola, Parainen, Finland

[73] Assignee: Ra-Shipping Ltd. Oy, Espoo, Finland

[21] Appl. No.: 267,659

[22] Filed: May 27, 1981

[51] Int. Cl.[3] ..... C21D 1/48

[52] U.S. Cl. ..... 148/15; 148/6.11; 148/143; 427/383.7; 427/433; 427/436

[58] Field of Search ..... 148/6.11, 15, 143; 427/383.7, 433, 436

[56] References Cited

U.S. PATENT DOCUMENTS 2,824,021 2/1958 Cook et al. ..... 427/433
3,782,909 1/1974 Clear et al. ..... 427/433
4,029,478 6/1977 Lee ..... 427/433
4,170,495 10/1979 Talikka ..... 148/15

*Primary Examiner*—John P. Sheehan
*Attorney, Agent, or Firm*—Scully, Scott, Murphy & Presser

[57] ABSTRACT

The invention relates to a method for producing coated high strength low alloy steel. A strip of steel is cleaned from rolling oil, is heated to the temperature range $A_1$ to $A_3$ in a protective atmosphere, is soaked and subsequently quenched in a zinc-aluminum bath for a short time sufficient to adhere a zinc coating to the steel surface, whereafter the steel strip is rapidly cooled to a temperature below 300° C., to obtain a dual-phase steel structure.

7 Claims, 2 Drawing Figures

METHOD FOR PRODUCING DUAL-PHASE AND ZINC-ALUMINUM COATED STEELS FROM PLAIN LOW CARBON STEELS

The present invention relates to a method for producing coated high strength low alloy steels of good formability. For use of such steels is expected to expand in the future e.g. in the motor car industry; a decrease in the weight of the car chassi reduces the fuel consumption of the car. Further, full scale use of high strength steels demands of the steels a good corrosion resistance, to obtain this, it is an object of the method according to the invention to coat the steel with a Zn-Al-alloy, which has a better corrosion resistance than conventional hot zinc coatings.

A good strength-elongation (ductility) proportion has been obtained by developing so called dual-phase steels, which contain 15–28% of martensite (or lower bainite) in a ferrite matrix. The dual-phase structure is obtained by means of a suitable heat treatment: the steel is annealed in the intercritical temperature range between the $A_1$ and $A_3$ temperatures in such a way, that a suitable proportion of austenite and ferrite is obtained. After this the steel is cooled or quenched thus, that the austenite is transformed to martensite or lower bainite. Austenite shall have sufficient hardenability in order to during a fast cooling transform to martensite or lower bainite. The required hardenability depends on the method of production and on the cooling rate made possible by the method.

The production methods in use can be divided into two main groups: the water quenching method and the gas cooling method. Water quenching methods (hot and cold water methods) enable the use of plain carbon steels due to its fast cooling rate (100° to 1000° C./s), still oxide tends to form into the steel surface wherefore the process requires pickling and in some cases tempering annealing. In addition, hot-dip galvanizing of these steels is impossible without loosing the desired mechanical properties.

In the other method type, the gas cooling method the steel is cooled by means of gas jets, enabling a cooling rate of 5° C. to 30° C./s. Because of the slow cooling rate plain carbon steels have to be alloyed in order to obtain sufficient hardenability, either with V, Cr or Mo, which increases the production costs. The gas cooling method makes it possible to produce hot-dip galvanized dual-phase steels.

It has now been found, that the right structure of dual-phase steels as well as elimination of the Luder's strain zero value, which is typical for the steels in question, depend on the steel alloying and the cooling time during which the steel stays in the temperature range of $A_1$ to 300° C., i.e. the longer the steel stays within this critical range the more the steel has to be alloyed. In the gas cooling method the steel stays within this range for about 60 to 75 seconds.

According to the present invention the steel is annealed in a furnace having a reducing atmosphere within the temperature range of $A_1$ to $A_3$ for 1 to 2 minutes. For the quenching after the annealing is used an eutectic zinc-aluminum alloy a so-called die casting alloy, with an aluminum content of 4 to 6% and a melting point for the alloy of 382° to 390° C., whereby the temperature of the metal bath may be e.g. 400° to 440° C. In the following stage when the steel has reached a temperature of 490° to 420° C. in the zinc bath and has been coated with a Zn-Al alloy, it is rapidly cooled by cold air jets and water-air-sprays to a temperature below 300° C., the complete quenching time being about 5 to 10 seconds. This makes it possible to use cheaper plain carbon steels (C=0.04 to 0.12%, Mn=0.6 to 1.6%, Si=0 to 0.5%) than in the gas cooling method. The addition of 4 to 6% of aluminum in zinc bath makes it possible to use a galvanizing temperature of 400° to 460° C., lower than in the Sendzimir process. According to performed tests the low galvanizing temperature together with the high aluminum content makes it possible to obtain a good adherence for the zinc coating although the zincing temperature of the steel is high. In addition, by regulating the temperature of the zinc bath the quenching rate of the steel can be controlled.

In the following the invention will be described with reference to the accompanying drawing.

Figure 1:
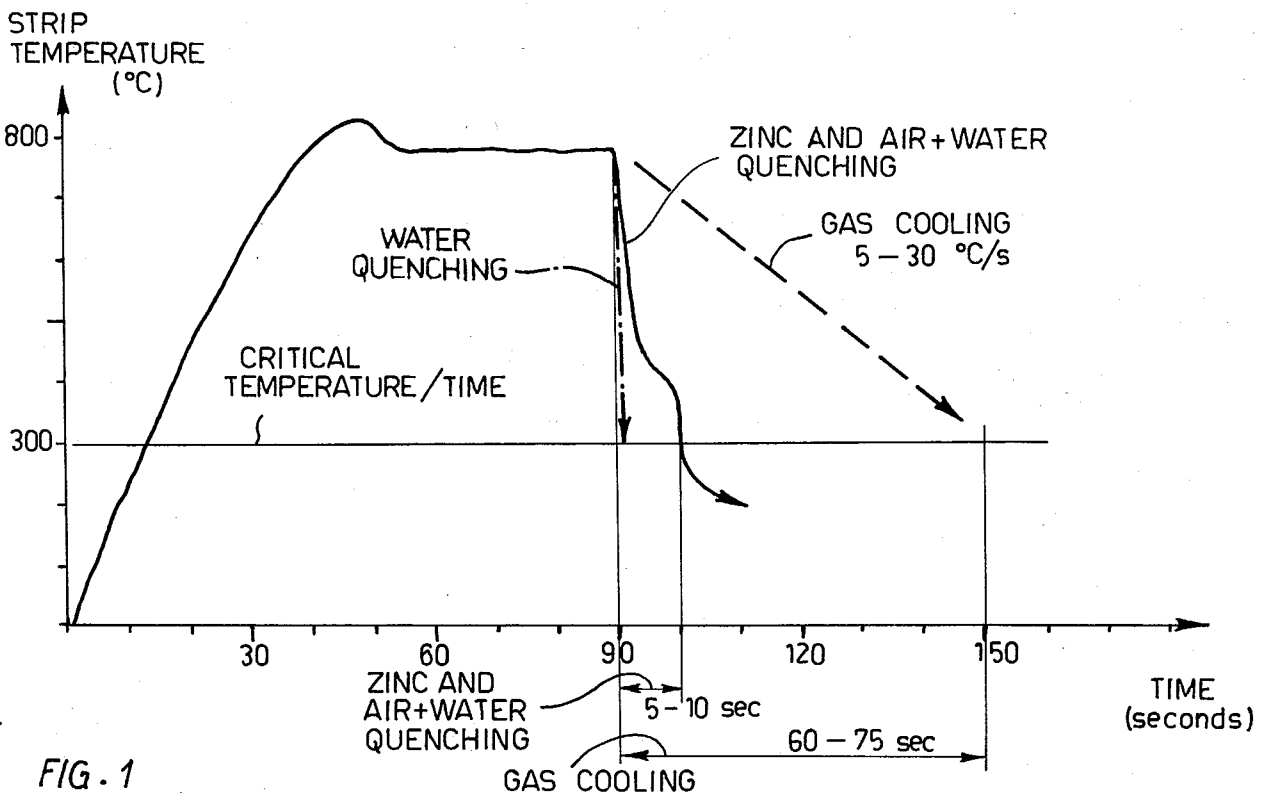
FIG. 1 is a temperature-time diagram illustrating the method of the invention in comparison to the water quenching and a gas cooling methods.
Figure 2:
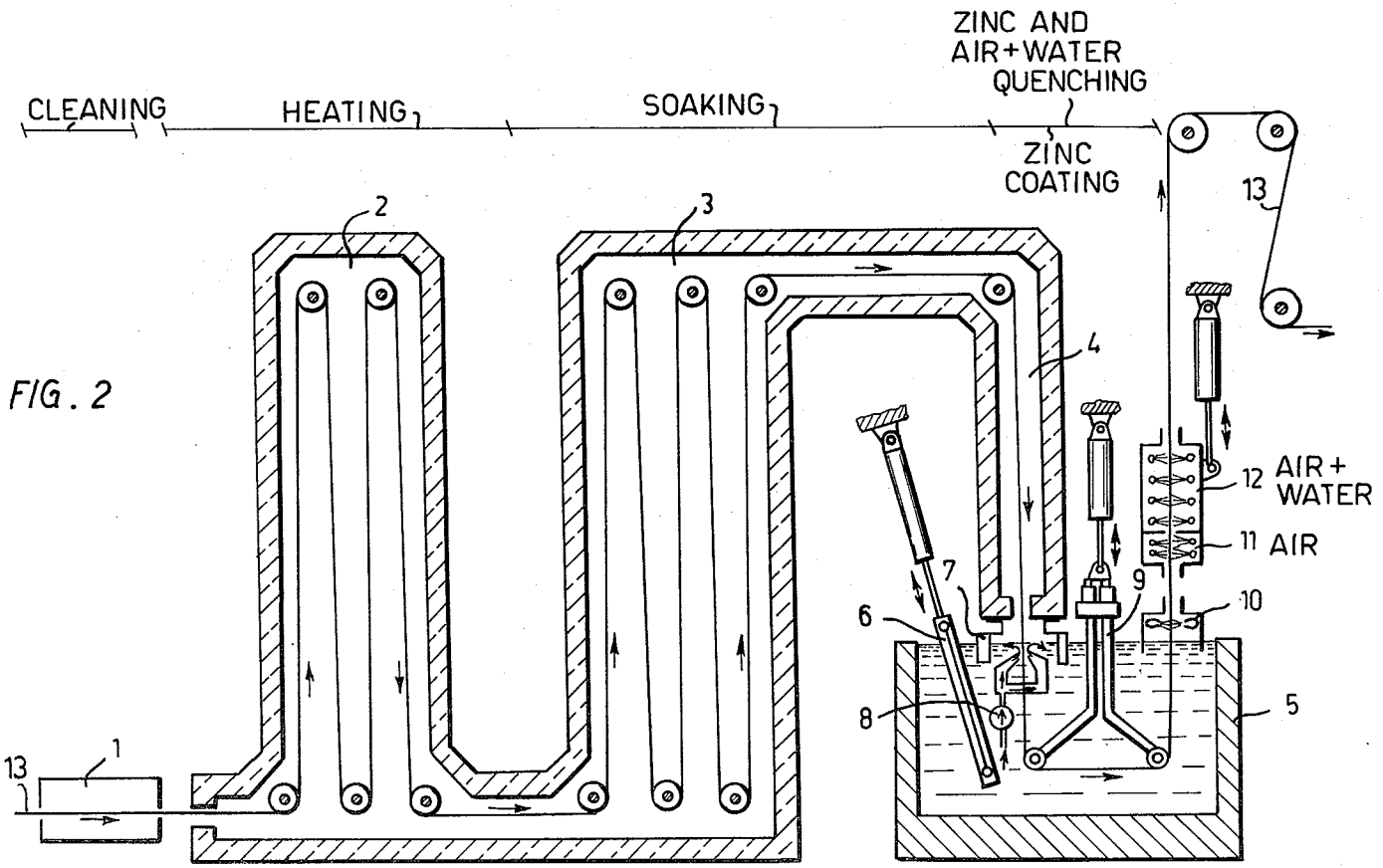
FIG. 2 shows schematically the production line used in performing the method of the invention, in a longitudinal section.

In FIG. 2 reference numeral 1 designates a unit for cleaning the steel strip from rolling oil. Numeral 2 indicates a furnace for heating the steel strip to the temperature range $A_1$ to $A_3$, 3 is a soaking furnace the last zone 4 whereof leads to a zinc-aluminum bath contained in a pot 5. In the zinc-aluminum bath is arranged a cooling unit 6, a likewise cooled snout 7 of the chute from the soaking furnace to the zinc-aluminum bath, a pump unit 8 for circulating the melt and a guiding roll arrangement 9 guiding the steel strip through the zinc-aluminum bath. Numerals 10 and 11 indicate gas jet nozzles and numeral 12 indicates air-water blowing jets. The steel strip to be treated is designated numeral 13.

The method of the invention works as follows:

After cleaning the steel from rolling oil the strip 13 is heated in the furnace 2 containing a protective atmosphere to the temperature range $A_1$ to $A_3$ and annealing continues in the soaking furnace 3. The atmosphere gas contains 10 to 25% hydrogen and 90 to 75% nitrogen. In the last zone 4 of the soaking-furnace the temperature of the steel is controlled suitably above the $A_1$ temperature before quenching in the zinc-aluminum bath. The pot 5 is ceramic and is provided with a cooling unit 6 or a heat exchanger to prevent the temperature of the zinc-aluminum bath from rising through the influence of the energy brought in by the steel strip. The snout 7 of the chute is preferably water cooled. The molten metal is circulated by means of a pump 8 preferably provided with a ceramic turbine in such a way, that the molten metal flows evenly against the surface of the strip through nozzles arranged on both sides of the strip and extending over the whole width thereof. Hereby the temperature at that point of the metal bath stays constant in spite of the large amount of heat energy contained in the steel strip and at the same time the quenching effect of the molten zinc can be regulated by means of the flow rate of the molten zinc. When the speed of the steel strip changes the galvanizing time can be kept constant by regulating the height position of the pot rolls 9. This regulating can in manners well known as such be arranged to take place automatically depending on the speed of the strip. After the zinc bath the thickness of the coating is regulated by means of gas jets nozzles 10. Immediately after this the molten coating is rapidly solidified by means of cold air jets whereafter the steel strip is rapidly cooled to a temperature below 300° C. by means of air-water blowing nozzles 12. The position of the cooling unit 11, 12 can be adjusted to different heights in accordance with the speed of the steel strip.

Essential in the method of the present invention is that the steel is quenched from a temperature in the $A_1$ to $A_3$ range, where the steel is partly in ferritic and partly in austenitic form, in a zinc-aluminum bath for such a time only, that a zinc coating is formed and adhered to the steel, whereafter the steel is further cooled rapidly by means of air and water jets to a temperature below 300° C. Hereby overaging of the plain low carbon steel is prevented, that is the Luder's strain is eliminated from the dual-phase steel.

What I claim is:

1. A method for producing coated high strength low alloy steel, comprising the consecutive continuous steps of cleaning a strip of steel from rolling oil, heating the strip in a furnace to the temperature range $A_1$ to $A_3$ in a protective atmosphere, annealing the strip in a soaking furnace at a temperature in the range of $A_1$ to $A_2$, quenching the strip in a zinc-aluminum molten metal bath for rapid cooling of the strip to a temperature in the range of 420° C. to 490° C. and for coating the steel with a zinc-aluminum alloy, and rapidly cooling the steel strip to a temperature below 300° C. in order to obtain a dual-phase structure.

2. The method according to claim 1, wherein the steel strip is quenched in a zinc-aluminum molten metal bath containing 4 to 6% aluminum.

3. The method according to claim 1, wherein the rapid cooling of the steel strip to a temperature below 300° C. is performed using gas jets and water jets in combination.

4. The method according to claim 1, wherein in the zinc-aluminum molten metal bath the melt is directed to flow evenly towards both surfaces of the steel strip to regulate the quenching effect and the zinc-aluminum molten metal bath is cooled to compensate for the heat brought therein by the steel strip.

5. The method according to claim 4, wherein the temperature of the zinc-aluminum molten metal bath is maintained within the range of 400° C. to 460° C.

6. The method according to claim 1, wherein the length of the path along which the steel strip travels in the zinc-aluminum molten metal bath is regulated by means of adjustable guide rolls in order to maintain a constant cooling time in the zinc-aluminum molten metal bath for different speeds of the steel strip and to maintain a constant complete quenching time for reaching the temperature below 300° C., whereby an even quality of the dual-phase structure and of the coating is obtained.

7. The method according to any of the preceding claims, wherein the complete quenching time for reaching the temperature below 300° C. is 5 to 10 seconds.

* * * * *